US009388523B2

(12) United States Patent
Han et al.

(10) Patent No.: US 9,388,523 B2
(45) Date of Patent: Jul. 12, 2016

(54) LAUNDRY TREATING APPARATUS

(75) Inventors: Jonghee Han, Seoul (KR); Hoil Jeon, Seoul (KR); Junghwan Lee, Seoul (KR); Jaeseok Seong, Seoul (KR); Yeji Um, Seoul (KR); Nerry Son, Seoul (KR); Yoonsang Kim, Seoul (KR); On Kim, Seoul (KR); Wookjun Chung, Seoul (KR); Kyungah Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 340 days.

(21) Appl. No.: 13/600,973

(22) Filed: Aug. 31, 2012

(65) Prior Publication Data

US 2013/0047680 A1 Feb. 28, 2013

(30) Foreign Application Priority Data

| | | |
|---|---|---|
| Aug. 31, 2011 | (KR) | 10-2011-0087778 |
| Aug. 31, 2011 | (KR) | 10-2011-0087906 |
| Sep. 5, 2011 | (KR) | 10-2011-0089476 |
| Sep. 5, 2011 | (KR) | 10-2011-0089477 |

(51) Int. Cl.

| | |
|---|---|
| ***D06F 39/14*** | (2006.01) |
| ***D06F 39/02*** | (2006.01) |
| ***D06F 29/00*** | (2006.01) |
| ***D06F 39/12*** | (2006.01) |

(52) U.S. Cl.

CPC ..... *D06F 39/02* (2013.01); *D06F 29/00* (2013.01); *D06F 39/12* (2013.01); *D06F 39/14* (2013.01)

(58) Field of Classification Search

CPC ..... D06F 39/14

See application file for complete search history.

(56) References Cited

U.S. PATENT DOCUMENTS

| | | | | |
|---|---|---|---|---|
| 2,899,816 | A | 8/1959 | Jacobsen, Jr. | 68/20 |
| 4,844,567 | A | 7/1989 | Chalabian | |
| 5,934,109 | A | 8/1999 | Kiefer et al. | |
| D577,162 | S | 9/2008 | Shail et al. | |
| 7,421,867 | B2 | 9/2008 | Bongini | |
| D589,215 | S | 3/2009 | Cho et al. | |
| D599,508 | S | 9/2009 | Choi et al. | |
| D617,965 | S | 6/2010 | Grutzke et al. | |
| D618,863 | S | 6/2010 | Jeon et al. | |

(Continued)

FOREIGN PATENT DOCUMENTS

| | | | |
|---|---|---|---|
| CN | 101570933 | A | 11/2009 |
| DE | 32 13 420 | A1 | 10/1983 |

(Continued)

OTHER PUBLICATIONS

European Search Report issued in Application No. 12182515.2, dated Aug. 5, 2013.

(Continued)

*Primary Examiner* — Jason Ko

(74) *Attorney, Agent, or Firm* — Ked & Associates, LLP

(57) ABSTRACT

An apparatus includes a first device to perform a first laundry treating operation and a second device to perform a second laundry treating operation. The first device has a first space to receive laundry through a first opening and the second device has a second space to receive laundry through a second opening. A controller controls the first and second devices to perform the first and second laundry treating operations respectively. The first device is coupled over the first device, and the first and second laundry treating operations are both washing operations or the first and second laundry treating operations are both drying operations.

18 Claims, 11 Drawing Sheets

(56) References Cited

U.S. PATENT DOCUMENTS

| | | | | |
|---|---|---|---|---|
| D618,871 | S | 6/2010 | DeSalvo et al. | |
| D627,528 | S | 11/2010 | Billig | |
| D631,624 | S | 1/2011 | Chung et al. | |
| D633,262 | S | 2/2011 | Jeon et al. | |
| D646,859 | S | 10/2011 | DeSalvo et al. | |
| 2004/0221624 | A1 | 11/2004 | Fumagalli | |
| 2004/0226320 | A1 | 11/2004 | Bongini | |
| 2005/0178165 | A1 | 8/2005 | Carey et al. | |
| 2007/0151120 | A1 | 7/2007 | Tomasi et al. | |
| 2008/0209954 | A1 | 9/2008 | Nakiri | |
| 2009/0072684 | A1 | 3/2009 | Woo et al. | |
| 2009/0090388 | A1* | 4/2009 | Kim et al. | 134/18 |
| 2009/0288452 | A1 | 11/2009 | Lee et al. | |
| 2010/0064543 | A1 | 3/2010 | Helot | |
| 2010/0107704 | A1 | 5/2010 | Seo et al. | |
| 2010/0132415 | A1 | 6/2010 | Cevikkalp et al. | |
| 2011/0174021 | A1 | 7/2011 | Lee et al. | 68/17 R |
| 2013/0047677 | A1 | 2/2013 | Han et al. | |

FOREIGN PATENT DOCUMENTS

| | | | |
|---|---|---|---|
| DE | 42 28 469 | A1 | 5/1993 |
| EP | 1 069 228 | A2 | 1/2001 |
| EP | 1 598 472 | | 11/2005 |
| EP | 2 050 858 | | 4/2009 |
| EP | 2 113 595 | | 11/2009 |
| EP | 2 325 377 | A1 | 5/2011 |
| FR | 2 736 942 | A1 | 1/1997 |
| JP | 62-295695 | | 12/1987 |
| JP | 09-0182897 | | 7/1997 |
| JP | 2004-180883 | | 7/2004 |
| JP | 2005-230544 | | 9/2005 |
| JP | 2007-068803 | | 3/2007 |
| JP | 2010-057969 | | 3/2010 |
| JP | 2011-518636 | | 6/2011 |
| JP | 2002-119786 | | 4/2012 |
| KR | 10-2002-0000074 | | 1/2002 |
| KR | 10-0404981 | | 1/2004 |
| KR | 10-2005-0114362 | | 12/2005 |
| KR | 10-0593380 | | 6/2006 |
| KR | 10-2007-0040901 | | 4/2007 |
| KR | 10-0730925 | | 6/2007 |
| KR | 10-2007-0074207 | A | 7/2007 |
| KR | 10-2008-0089814 | A | 10/2008 |
| KR | 10-2008-0101377 | A | 11/2008 |
| KR | 10-2010-0054341 | | 5/2010 |
| KR | 10-2011-0013150 | | 2/2011 |
| WO | WO 02/14593 | | 2/2002 |
| WO | WO 2011/136609 | | 11/2011 |
| WO | WO 2012/085825 | | 6/2012 |

OTHER PUBLICATIONS

International Search Report and Written Opinion dated Mar. 4, 2013 issued in Application No. PCT/KR2012/006974.

Written Opinion of the International Searching Authority dated Mar. 7, 2013.

European Search Report dated Apr. 2, 2013.

European Search Report dated Aug. 1, 2013.

International Search Report and Written Opinion dated Sep. 30, 2013 issued in Application No. PCT/KR2012/006975.

United States Office Action issued in U.S. Appl. No. 13/600,822 dated May 20, 2015.

U.S. Appl. No. 13/600,822, filed Aug. 31, 2012.

U.S. Appl. No. 14/827,673, filed Aug. 17, 2015.

U.S. Office Action dated Oct. 23, 2015 issued in U.S. Appl. No. 13/600,822.

Chinese Office Action issued in Application No. 201280042228.6 dated Jun. 30, 2015 (Full English Translation).

Chinese Office Action dated Jul. 30, 2015 issued in Application No. 201280042333.X (Original Office Action with English Translation).

U.S. Office Action dated Mar. 30, 2016 issued in U.S. Appl. No. 13/600,822.

European Search Report dated Mar. 11, 2016.

* cited by examiner

LAUNDRY TREATING APPARATUS

CROSS-REFERENCE TO RELATED APPLICATIONS

This application claims the benefit of Korean Patent Application No. 10-2011-0087906, filed on Aug. 31, 2011, Korean Patent Application No. 10-2011-0087778, filed on Aug. 31, 2011, Korean Applications No. 10-2011-0089477, filed on Sep. 5, 2011, and Korean Patent Application No. 10-2011-0089476, filed on Sep. 5, 2011, which is hereby incorporated by reference as if fully set forth herein.

BACKGROUND

1. Field

One or more embodiments described herein relate to treating laundry.

2. Background

Generally, a laundry treating apparatus includes a washing machine, a drying machine and a washing machine having a drying function that can perform washing and drying together. Such a washing machine having a drying function is provided with a single device that is able to perform both washing and drying. In this instance, an inner structure of the washing machine having the drying function might be complex and spatial utility of the washing might be deteriorated.

In other words, when a drying function is provided to a washing machine, an auxiliary device for drying has to be provided rather than components such as a tub and a drum. The washing machine having the drying function requires a space occupied by the device for the drying. The device for the drying has to be provided in the washing machine having the drying function and an internal space of the washing machine having the drying function might be complex accordingly.

As a result, it is difficult to provide an auxiliary space such as a storage space to a washing machine having a drying function. Meanwhile, a washing machine having only a washing function and a drying machine having only a drying function have the following disadvantages.

FIG. 1 illustrates one type of washing machine including a single washing machine 300 and a drawer 320 as an auxiliary space provided in a bottom of the single washing machine 300. The drawer 320 is directly provided in a cabinet 310 of the washing machine. That is, the drawer 320 is not provided as an auxiliary machine.

In this instance, to install the washing machine provided with the drawer, an installation space is required as much as the entire height of the washing machine provided with the drawer. Accordingly, such the washing machine requires a large installation space and a user cannot be provided with the washing machine without drawer provided therewith.

Moreover, even if the bottom drawer is provided by an auxiliary device, namely, a pedestal, the internal structure of the machine located on the top of the drawer is complex and there is little room in the internal space. Accordingly, it is difficult to provide an auxiliary space for the user to the top machine.

Also, a front part of the washing machine is perpendicular to the ground and it is not easy for the user to load washing-objects into the washing machine.

SUMMARY

One or more embodiments described herein provide a laundry treating apparatus that is able to provide an auxiliary space such as a storage space, rather than a space for laundry treating such as washing or drying.

One or more embodiments may also provide a laundry treating apparatus that enables a user to load laundry therein, without bending his or her waist.

One or more embodiments may also provide a laundry treating apparatus that includes a space for treating laundry that is closed and airtight.

One or more embodiments may also provide a laundry treating apparatus including a space for treating laundry of which an internal structure is changeable according to a type of laundry.

In accordance with one embodiment, a laundry treating apparatus includes a first treating device having a cabinet provided with an opening formed to load and unload laundry there through; a support part supporting the first treating device; and a second treating device provided underneath the support part to treat laundry. The support part may be integrally formed with the first treating device. An inclined part projected in a direction getting far from a front surface of the support part may be further provided in a front surface of the first treating device.

The laundry treating apparatus may further include a door tilted at a first angle with respect a line perpendicular to the ground to open and close the opening. When the door closes the opening, a lower end of the door may be projected in a direction getting far from the supporting part.

The laundry treating apparatus may further include at least one detergent introduction part provided in a lower portion of the opening to supply detergent to the first space. The detergent introduction part may be tilted at a predetermined angle with respect to a line perpendicular to the ground and the angle may be larger than the first angle. The door may open and close the opening and detergent introduction part.

The laundry treating apparatus may further include a steam generator supplying steam to the first space; and a water element introduction part provided in a lower portion of the opening to supply water elements to the steam generator. The door may open and close the opening and the water element introduction part.

The laundry treating apparatus may further include a control panel provided in the door to control an operation of the first treating device. The maximum open angle of the door may be set. When the door is open a predetermined angle or less, the door may maintain an open angle. When the door is open more than a predetermined angle, the door may rotate to the maximum open angle spontaneously.

The laundry treating apparatus may further include a light emitting part selectively closed by the door. A tub holding wash water may be further provided in the first treating device and the lowest height of the tub may be the half of the height of the laundry treating apparatus or larger than the height of the laundry treating apparatus.

The second treating device may include a housing provided under the support part, the housing defining an exterior appearance of the second treating device; and a drawer movable from and into the housing, the drawer in which the second space is formed. A top of the drawer may be an inclined surface inclined downward along a direction of the drawer moved into the housing, and the housing may further include a drawer cover closing the tub by contacting with the inclined surface of the drawer.

The second treating device may include a housing provided under the support part, the housing defining an exterior appearance of the second treating device; a drawer movable from the housing, the drawer in which the second space is formed; and a drying rack fixed to a surface of the second space to be unfolded to the other surface of the second space or to be folded to the surface of the second space.

One or more of these embodiments may have advantageous effects including providing a support part capable of providing an auxiliary space such as a storage space rather than a space for washing or drying. Accordingly, utilization of the laundry treating apparatus may be enhanced.

In this instance, the support part may be provided in the first treating device and the auxiliary space independent from the space for washing or drying provided in the first treating device may be provided even when the second treating device is not provided in the laundry treating apparatus.

Furthermore, the user may select whether to install the second treating device according to the installation space of the laundry treating apparatus.

Still further, the surface where the laundry is introduced may be tilted and the user may load the laundry without bending his or her waist.

Still further, the opening having the laundry loaded or unloaded there through may be projected in the direction getting far from the front surface of the laundry treating apparatus. Accordingly, the loading or unloading of the laundry may be easily performed.

Still further, the second space provided in the second treating device to accommodate the laundry may be sealed in the laundry treating apparatus according to the present invention.

Still further, the inner structure of the second space provided in the second treating device may be changed according to the size, the kind or the amount of the laundry in the laundry treating apparatus.

DETAILED DESCRIPTION

Figure 1:
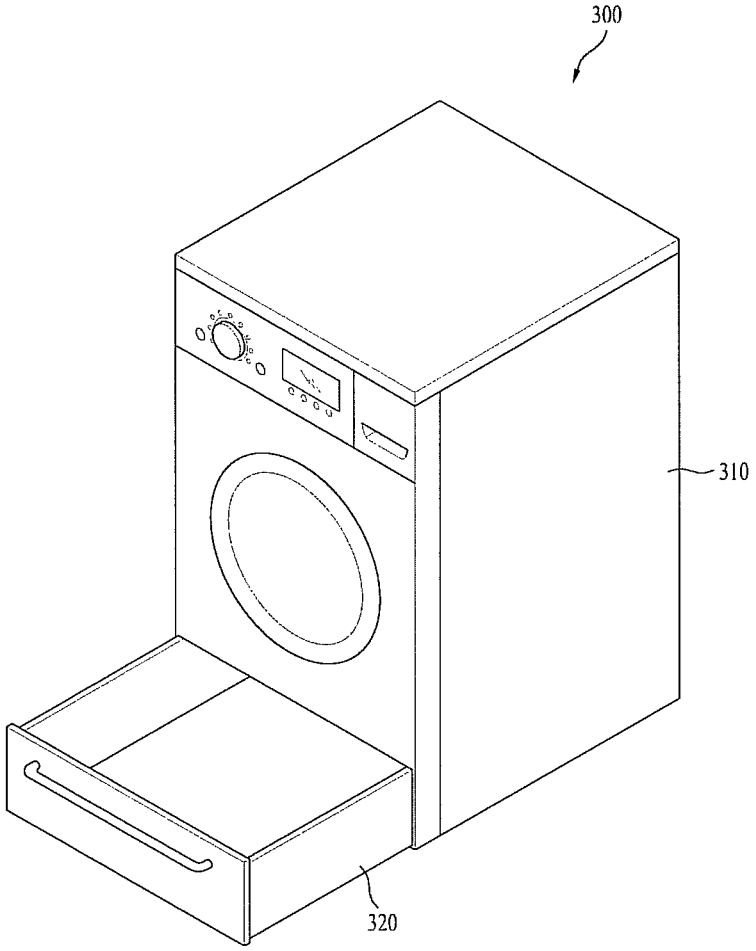
FIG. 1 shows one type of washing machine.
Figure 2:
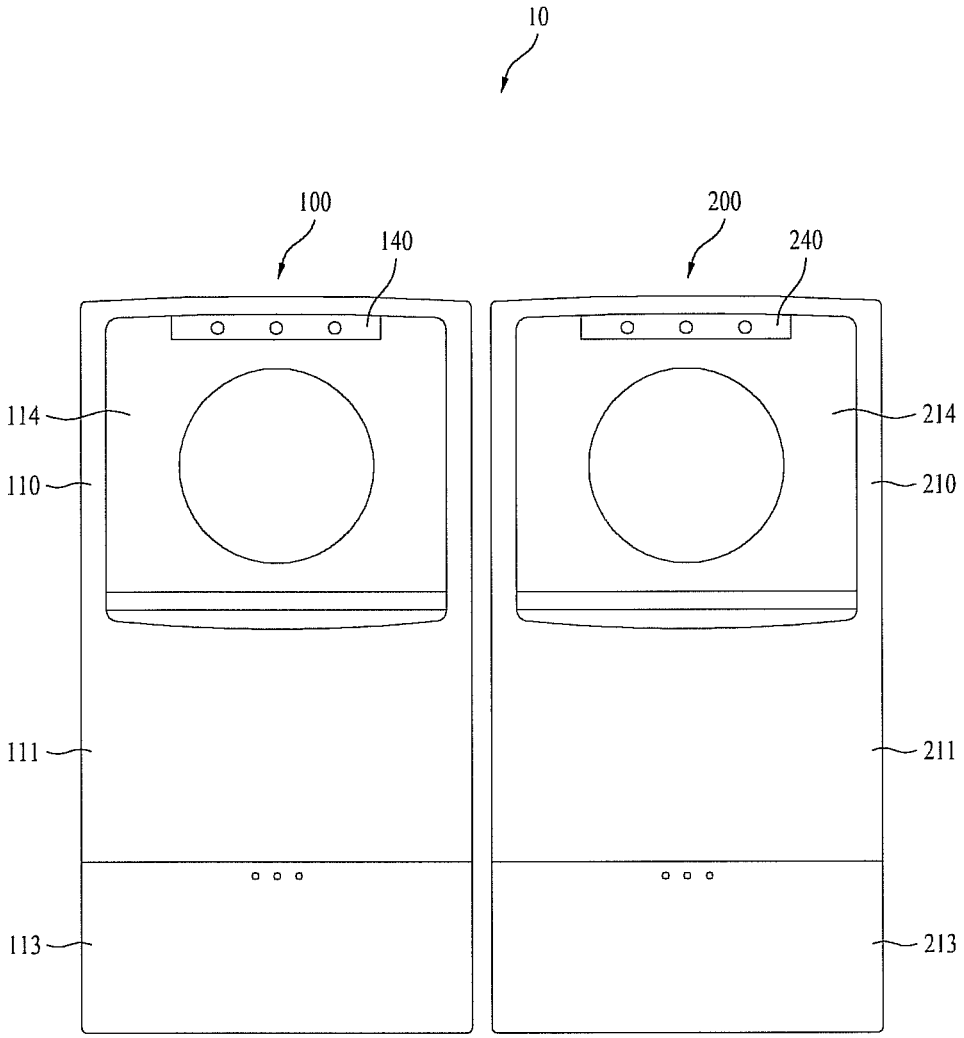
FIG. 2 shows a view of one embodiment of a laundry treating apparatus.

FIG. 2 is a front view of a laundry treating apparatus 10 that includes a washing machine 100 and drying machine 200 which may be coupled to each other.

Generally, a laundry treating apparatus includes a washing machine that can perform washing, a drying machine that can perform washing and a washing machine having a drying function that can perform washing and drying together. Such a washing machine having a drying function is provided with a single device that is able to perform both washing and drying. However, to perform washing and drying together, an inner structure of the washing machine having the drying function cannot help but be complicated.

Accordingly, because of a structural disadvantage that it difficult to provide a separate space from a space for washing and drying in the washing machine having the drying function, it is preferred that the washing machine 100 and the drying machine 200 are functionally separated in accordance with at least one embodiment of the laundry treating apparatus.

In other words, even when the washing machine 100 and the drying machine 200 are coupled to each other in the laundry treating apparatus 10 as shown in FIG. 2, the washing machine may perform only a function related to washing and the drying machine may perform only a function related to drying. Also, different from what is shown in FIG. 2, the laundry treating apparatus 10 according to one embodiment may be provided with only the washing machine performing only the function related to washing or it may be provided with only the drying machine 200 performing only the function related to drying.

Meanwhile, in accordance with one embodiment, the structures of the washing machine and drying machines provided in the laundry treating apparatus shown in FIG. 2 may be similar to each other. Accordingly, the washing machine will be described to explain the laundry treating apparatus and different features of the drying machine will be described in detail, compared with features of the washing machine.

Figure 3:
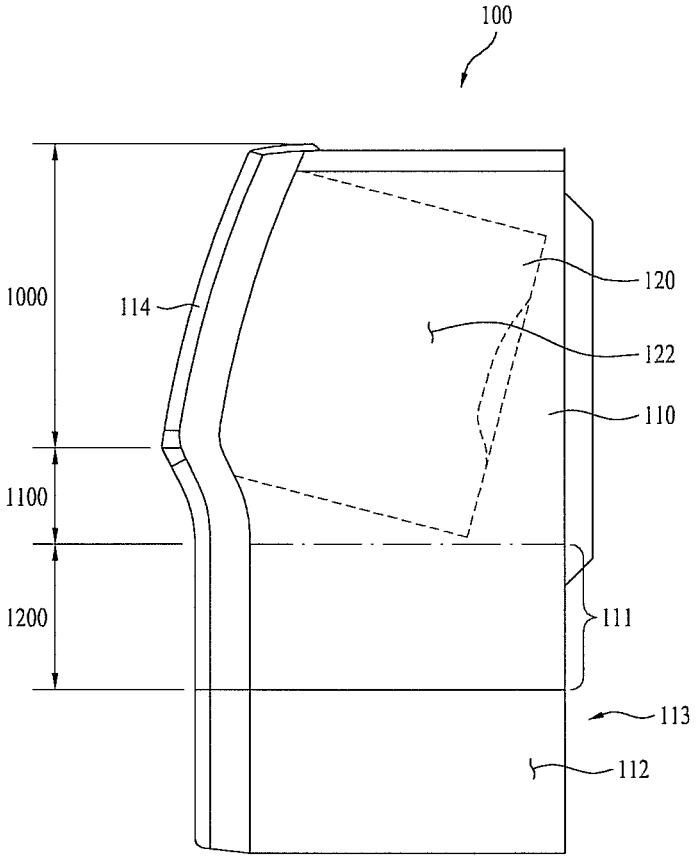
FIG. 3 shows a washing machine in the apparatus of FIG. 2.

As shown in FIGS. 2 and 3, according to one embodiment the washing machine 100 includes a first treating device (110, a first washing machine) with a first space 122 for treating (such as washing) laundry and a second treating device (113, a second washing machine) provided under the first treating device, with a second space 112 for treating laundry.

The first treating device 110 includes a cabinet for defining an exterior appearance thereof, a first space 122 provided in the cabinet and an opening (119, see FIG. 4) provided in the cabinet to load or unload laundry into or out of the first space.

The opening 119 may be open and closed by a door 114 and the first space 122 provided in the washing machine is provided with a tub 120 located in the cabinet to store wash-water and a drum (121, see FIG. 4) pivotally provided in the tub. In this instance, a tub opening (not shown) may be provided in the tub 120, in communication with the opening 119, and a drum opening (not shown) may be provided in the drum 121, in communication with the tub opening.

The first treating device 110 may be supported by a support part 111. That is, the support part 111 may be provided between the first treating device 110 and the second treating device 113 to support the first treating device 110. The support part 111 may be independently provided with respect to the first treating device 110 or it may be integrally formed with the first treating device 110 as shown in FIG. 2.

When the support part 111 is integrally formed with the first treating device 110, a bottom part of the 120 provided in the first treating device 110 may be defined as the support part 111. In other words, a bottom of the tub 120 and a top of the second treating device 113 shown as a dotted line in FIG. 3 may be defined the support 111.

When the support part 111 is independently provided from the first treating device 110, the support part 111 may be provided to support the bottom of the first treating device 110.

The support part integrally fondled with the first treating device will be adapted and described as follows.

When the support part 111 provided under the first space 122, with a predetermined height, there may be an effect that the inner space of the support part 111 can be utilized variously. In other words, the drum 121, the tub 120 and apparatus for rotating the drum (not shown, such as a motor) and a device required by the washing may be arranged in a predetermined portion of an internal space formed in the cabinet of the first treating device 110. The other space provided by the support part 111 in the cabinet may be used as an auxiliary space such as a storage space.

For example, when such a storage space is formed in the space formed by the support part 111, the user may store accessories for the washing such as detergent in such a storage space. The storage space may be provided as a drawer retractable from the support part. If the storage space is not a drying machine type, opening and closing means may be provided in a surface of the support part 111 to provide the user with access to the storage space.

Meanwhile, the second treating device (113, the second washing machine) having a second space 112 for providing auxiliary treating with the laundry, with supporting the first treating device 110 and the support part 111 may be provided underneath the support part 111. In other words, the second treating device 113 provided underneath the supporting part 111 may support the first treating device 111 and the support part 111 and it may be employed for different treating for laundry, compared with the first treating device 110.

The second treating device 113 may be integrally formed with the first treating device 110 and the support part 111. In accordance with one embodiment, the second treating device 113 is independent from the first treating device 110 as shown in FIG. 2. If the second treating device 113 is integrally formed underneath the first treating device 110 and the support part 111, the overall height of the washing machine 110 will be increased only to require a large space for installing the washing machine.

When there is a sufficient space to install the second treating device 113 that is detachable from the first treating device 110, the user may install the second treating device 113 together with the first treating device 110. When there is no sufficient space to install the second treating device 113, the user may install only the first treating device 110 and the support part 111.

Meanwhile, the support part 111 is provided in the first treating device 110 (or under the first treating device) in the laundry treating apparatus, even without the second treating device 113. Accordingly, the user may be provided with the auxiliary space such as the storage space advantageously.

When the second treating device 113 is provided, the tub 120 of the first treating device 110 may be provided as high as half or more of the height possessed by the washing machine 100. That is, the height possessed by the bottom of the tub 120 may be half or more of the height possessed by the washing machine 100. That is to secure a sufficient space in the support part 111 as mentioned above.

Thus, the height of the washing machine 100 may be defined as the total sum of the height of the first treating device 110, the height of the support part 111 and the height of the second treating device 113.

If the height of the bottom of the tub 120 is less than the half of the height of the washing machine 100, it might be difficult to secure a sufficient space in the support part 111. Accordingly, the space inside the support part 111 may be secured, to limit the height of the tub 120, specifically, the height of the bottom of the tub 120.

Figure 6:
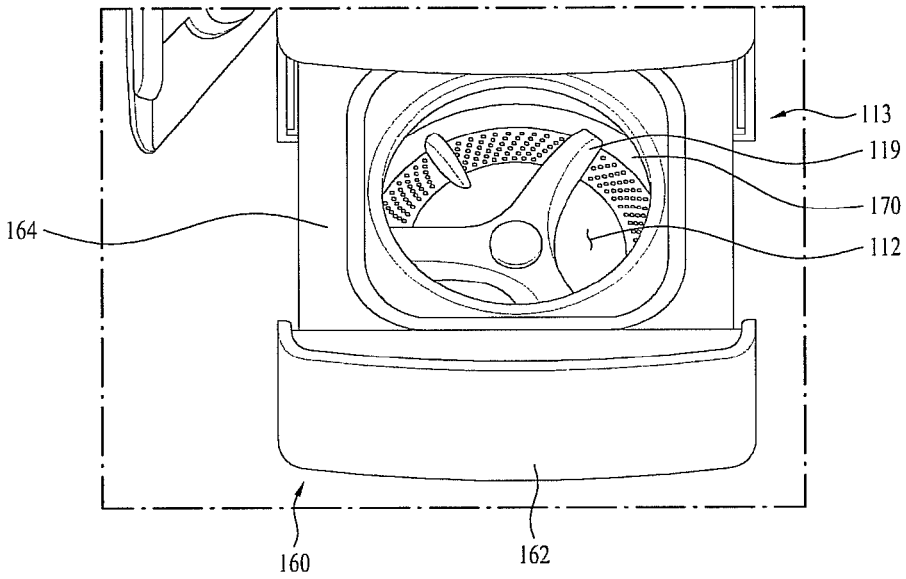
FIG. 6 shows a second treating device in the washing machine in a state where a drawer of the second treating device is moved outward.

For example, the second treating device 113 may be a drawer that is retractable (160, see FIG. 6). That is, an inner space of the drawer 160 may be used as the storage space or the space for treating laundry, which will be described in detail later.

Meanwhile, the drying machine 200 provided in the laundry treating apparatus may include a first treating device (210, a first drying machine) with a first space (not shown) for treating (such as drying) laundry and a second treating device (213, a second drying machine) provided under the first treating device, with a second space (not shown) for treating laundry.

The first treating device 210 may include a cabinet for defining an exterior appearance thereof, a first space provided in an internal space of the cabinet and an opening (219, see FIG. 5) provided in the cabinet to load or unload laundry there through.

In the drying device 200, only the drum 220 for holding laundry may be provided in the first space. In this instance, a drum opening (not shown) may be provided in the drum 220, in communication with the opening 219, and the opening 219 and the drum opening may be open and closed by a door 214.

Meanwhile, a support part 211 may be provided between the first treating device 210 and the second treating device 213 to support the first treating device 210. Like the support part 111 of the washing machine, the support part 211 may be integrally formed with the first treating device 210 or independently provided with respect to the first treating device 210. The second treating device 213 may be a drawer (not shown).

The structure of the drying machine 200 mentioned above may be similar to that of the washing machine 100, except the structure of the first space, and detailed description thereof will be omitted accordingly.

A predetermined portion of a front surface of the first treating device 210 (a predetermined portion of a surface having the opening formed therein provided in the cabinet) provided in the washing machine 100 may be projected in a direction that is far from a front surface of the support part 111 (or a direction that is far from a front surface of the second treating device). In other words, the surface in which the opening formed in the cabinet provided in the first treating device 100 may have an inclined surface projected getting far from the front surface of the second treating device 113.

When the front surface of the first treating device 110 is projected toward a downward direction as shown in FIG. 3, the tub 120 and the drum 121 provided in the first treating device 110 may be upwardly tilted toward a forward direction. That is for the user to load laundry conveniently into the first treating device 110 after opening the door 114.

In other words, the opening 119 is projected from the front surface of the support part 111 or the second treating device 112 in a direction getting far from the support part 111 or the front surface of the second treating device 112 in the laundry treating apparatus, such that a user may approach the opening 119 more closely.

Unless the opening 119 is projected in the direction getting far from the front surface of the second treating device 112 or the support part 111, the minimum distance between the user and the opening 119 may be the size of the user's foot.

However, when the opening 119 is projected in the direction getting far from the front surface of the second treating device or the support part 111 in the laundry treating apparatus, a minimum distance between the user and the laundry treating apparatus may not be limited by the size of the user's foot and the user may approach to the opening 119 more closely without bending his or her waist.

Moreover, according to one embodiment, the drum and the tub are tilted in the laundry treating apparatus. Accordingly, the user may load laundry into the drum without bending his or her waist.

More specifically, the front surface (the surface of the cabinet where the opening is provided) of the first treating device 110 is inclined at a first angle with respect to a virtual line perpendicular to the ground. The door 114 provided in the front surface of the first treating device 110 may be tilted at a first angle with respect to a virtual line perpendicular to the ground.

In this instance, a lower end of the door 114 may be projected from the first treating device 110 in a direction getting far from a front surface of the support part 111 as much as possible.

Meanwhile, as shown in FIG. 3, an inclined part provided in the front surface of the washing machine 100 may include a first inclined surface 1000 inclined at a first angle, a second inclined surface 1100 inclined at a second angle and a linear surface 1200 substantially perpendicular with respect to the ground.

The first inclined surface 1000 may be inclined to be forwardly projected toward a lower portion from an upper portion of the washing machine 100. The second inclined surface 1100 may be inclined in the reverse direction of the first inclined surface 1000 with respect to a virtual line perpendicular to the ground.

In other words, the first inclined surface 1000 and the second inclined surface 1100 may be provided in the front surface of the first treating device 110 mentioned above. A connected point between the first inclined surface 1000 and the second inclined surface 1100 may be projected in a direction getting far from the front surface of the second treating device 113 or the front surface of the support part 111. In this instance, the opening 119 and the door 114 provided in the first treating device 110 may be provided in the first inclined surface 1000.

At least a predetermined area of the first inclined surface 1000 may be covered by the door 114. In this embodiment, when the door 114 is closed as shown in FIG. 2, most of the area of the first inclined surface 1000, for example, more than 80 to 90% of the first inclined surface, may be covered by the door.

When most of the area of the first inclined surface 1000 provided in the first treating device 100 is closed by the door 114, a control panel (140, a device for inputting control commands and for displaying control processes) for operating the washing machine 100 may be provided in the door 114.

If the control panel 140 is provided in the area covered by the door 114 in the first treating device 110, it might be inconvenient of the user to open the door 114 to operate the control panel 140. Accordingly, the control panel 140 may be provided in a front surface of the door 114, in other words, it may be provided to be exposed even when the door 114 is closed. The control panel may be used to control laundry treating operation to be performed by the first and second treating devices 110 and 113, or separately control panels may be provided for these devices.

A control panel 240 may also be provided in the door 214 in the drying machine 200. A detailed structure of the control panel 240 is similar to the structure of the control panel 140 provided in the washing machine and repeated description will be omitted. That is, a single integral control panel may be provided for both devices 210 and 213 or separate control panels may be provided for these devices.

Meanwhile, the linear surface 1200 may be extended from the second inclined surface, perpendicular to the ground or forming a flat surface parallel to a front surface of the second treating device 113. The linear surface 1200 may support the support part 111. In other words, the support part 111 may be perpendicular to the ground or form a flat surface in parallel to the front surface of the second treating device, to support the first treating device 110.

Figure 4:
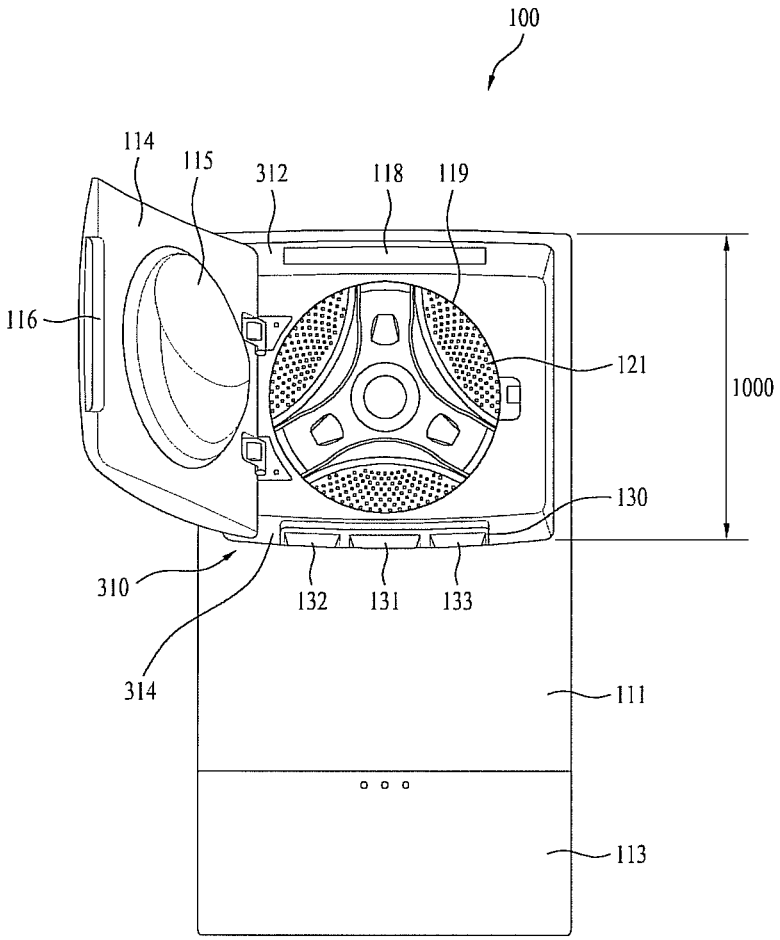
FIG. 4 shows a front view of the washing machine having an open door.

FIG. 4 illustrates the washing machine 100 of which the door 114 is open. Referring to FIG. 4, the door 114 includes a handle part 116 to be held by the user when the user tries to open or close the door 114 and a transparent part 115 that is transparent to make the inside of the first treating device 110 visible.

Moreover, the maximum open angle of the door 114 is preset. When the door is open at a preset angle or less, an open angle may be maintained. When the door is open more than the preset angle, the door is open to the maximum open angle spontaneously.

Meanwhile, a holding part 310 may be provided in the front surface, for example, the first inclined surface 1000 of the first treating device 110 to hold the door 114 when the door 114 is closed. In other words, when the door 114 is closed, the holding part 310 may hold the door 114 to prevent the door 114 from being projected from the first treating device 110.

In an upper area of the opening 119, specifically, a predetermined area of the holding part 310 located in the upper area of the opening 119 may be provided a light emitting part 118 to enable the user to see and check the inner space (or the inside of the first space) of the first treating device 110 when the user is loading laundry.

The light emitting part 118 may be luminous only when the door 114 is open. For example, a sensor for sensing the opening of the door 114 may be provided and a control unit controls whether to operate the light emitting part based on a signal transmitted by the sensor. Alternatively, when the door 14 is open, the light emitting part 118 may be luminous by a mechanical structure or a circuit configuration.

Meanwhile, the light emitting part 118 may be luminous only when the door 114 is open. It is preferred that the light emitting part 118 is provided in the holding part 310 that is the area covered by the door when the door 114 closes the opening 119.

Moreover, at least one detergent introduction part 130 may be provided under the opening 119, in other words, in the holding part 310 positioned under the opening 119. That is, the detergent introduction part 130 may include a main-washing detergent introduction hole 131 for main-washing, a preliminary-washing detergent hole 132 for preliminary washing and a fabric softener introduction hole 133.

The user may introduce detergent via the detergent introduction part 130 and those detergents may be provided to the inside of the drum 121, together with the wash water supplied by a water supply part (not shown). Such the detergent introduction part 130 may be utilized only when performing the washing and it is preferred that the detergent introduction part 130 is provided in the holding part 310 that is the area covered by the door 114 when the door 114 closes the opening 119.

As a result, the door 114 may be provided to selectively open and close the opening 119 and the detergent introduction part 130. Moreover, the door 114 may be provided selectively expose the light emitting part 118.

Meanwhile, the holding part 310 that holds the door 114 may include an upper inclined portion 312 and a lower inclined portion 314. The upper inclined portion 312 and the lower inclined portion 314 may be inclined toward the opening 119 to hold the door 114. In this instance, the light emitting part 118 mentioned above may be provided in the upper inclined part 312 and the detergent introduction part 130 may be provided in the lower inclined portion 314.

The lower inclined portion 314 where the detergent introduction part 130 is provided may be inclined at a predetermined angle with respect to a virtual line perpendicular to the ground and the angle may be larger than the first angle of the first inclined surface 1000 or the door 114.

In other words, the lower portion 314 is inclined at a larger angle than the first angle with respect to the line perpendicular to the ground. Accordingly, the lower inclined portion 314 is more likely to lie toward the ground. As the lower inclined portion 314 having the detergent introduction part 130 provided therein is getting perpendicular to the ground, it is getting more difficult for the user to introduce the detergent via the detergent introduction part 130. Accordingly, the angle of the lower inclined portion 314 having the detergent introduction part 130 is provided may be larger than the first angle with respect to the line perpendicular to the ground.

Figure 5:
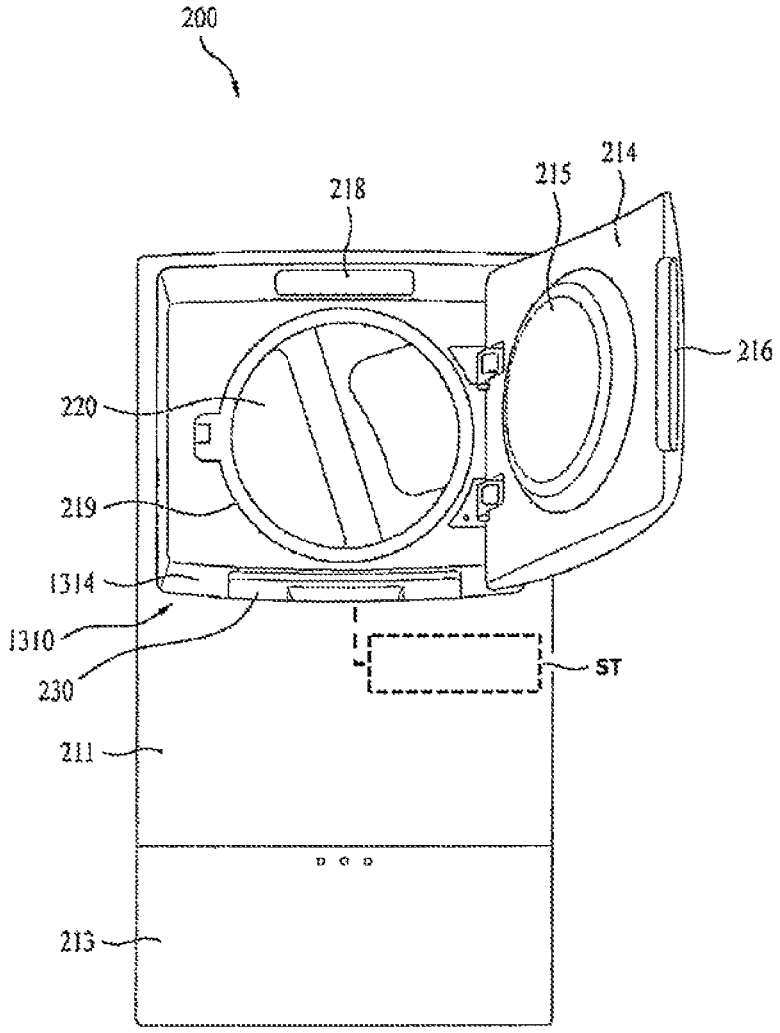
FIG. 5 shows a drying machine in the apparatus shown of FIG. 2 in a state where a door provided in a drying machine is open.

Meanwhile FIG. 5 illustrates the door 214 of the drying device 200 that is open. In the drying machine 200, it is preferred that the door 213 is open in a different direction from the open direction of the door in the washing machine 100. In other words, when the washing machine and the drying machine are arranged side by side, the doors may be provided to be open outwards. That is to introduce the laundry into the drying machine with no inference of the door when the washed laundry is introduced into the drying machine immediately.

The door 214 of the drying machine 200 may include a handle part 216 and a transparent part 215 as well. Meanwhile, the drying machine 200 includes a holding part 1310 in which the door 214 is held and a light emitting part 218. Those structures are similar to the structures of the washing machine and repeated description will be omitted accordingly.

The drying machine 200 requires no detergent introduction and no detergent introduction part is provided in the drying machine. However, a steam generator (ST) may be provided in the drying machine 200 to supply a high temperature water element such as steam to the laundry loaded in the drum 220.

In this instance, the steam generator may heat water to supply the high temperature water elements and a water element introduction part 230 has to be provided in the drying machine to supply water to the steam generator. Accordingly, the drying machine 200 may include a water element introduction part 230 provided in a lower inclined portion 1314 of the holding part 1310.

The inclined angle of the lower inclined portion 1314 may be larger than an installation angle of the door 214 in the drying machine 200, like the washing machine 100. Accordingly, the user may introduce water elements easily. The door 214 may selectively open and close the opening 219 and the water element introduction part 230 and it may selectively expose the light emitting part 218.

Meanwhile, in the embodiment mentioned above, the detergent introduction part 130 is provided in the washing machine 100 and the water element introduction part 230 is provided in the drying machine 200. In other embodiments, the laundry treating apparatus may have a different structure.

For example, a steam generator and a water element introduction part may be provided in the washing machine 100. In this instance, a detergent introduction part and a water element introduction part may be provided in the lower inclined portion of the washing machine side by side.

FIG. 6 is a perspective view illustrating an example of the structure of the second treating device 113. The second treating device 113 may include a drawer 160 that is retractable. The drawer 160 may include a front surface 162 and a both part 164. A drum 170 that provides a second space 112 to hold laundry may be provided in the body part 164. In this instance, the drum 170 may be pivotally provided or fixed. When the drum is fixedly provided, a rotary pulsator (or agitator) 119 may be provided under the drum 170.

Figure 7:
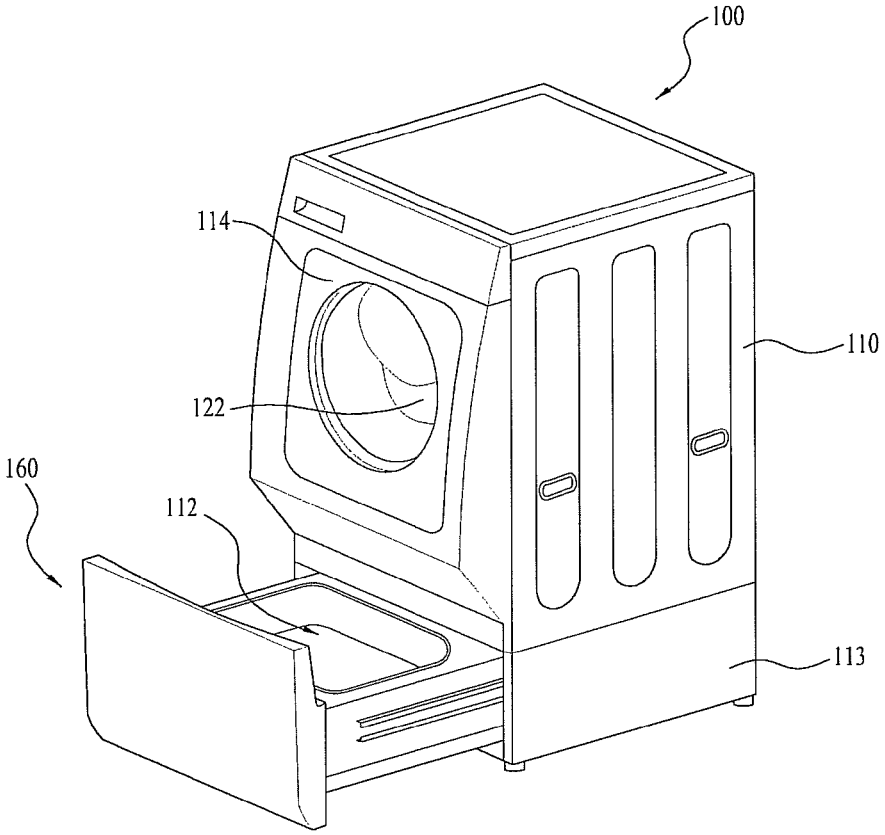
FIG. 7 shows another embodiment of a washing machine.

FIG. 7 shows another embodiment of a washing machine 100 provided in the laundry treating apparatus. The washing machine 100 according to this embodiment also includes a first treating device 100 with a first space 122 for treating laundry and a second treating device 113 provided under the first treating device, with a second space 112 for treating laundry.

The first space 122 and the second space 112 may have the same laundry treating capacity (such as a washing capacity). Considering the installation space of the washing machine and the price of the washing machine, it is preferred that one of the first and second spaces has a smaller capacity than the other.

In other words, as shown in the drawings, at least one of the washing capacity, the volume and the height possessed by the second space 112 may be smaller than at least one of those conditions possessed by the fist space 122. Accordingly, the user may select and use one of the first and second treating devices 110 and 113 according to the size of the laundry.

In addition, the user may select one of the first and second treating devices 110 and 113 according to the kind of the laundry to wash the laundry. For example, predetermined types of laundry that are necessarily categorized before washing such as baby clothes and lingerie may be washed in the second treating device 113 and the other types of the laundry may be washed in the first treating device 110.

The second treating device 113 may include a drawer 160 that can provide a second space 112, with being movable outwards. When the washing capacity of the second space 112 is smaller than that of the first space 122, the second treating device 113 may be a top loading type which allows laundry loaded into a top thereof. Accordingly, the user may load or unload laundry into or out of a second space 112 easily.

Figure 8:
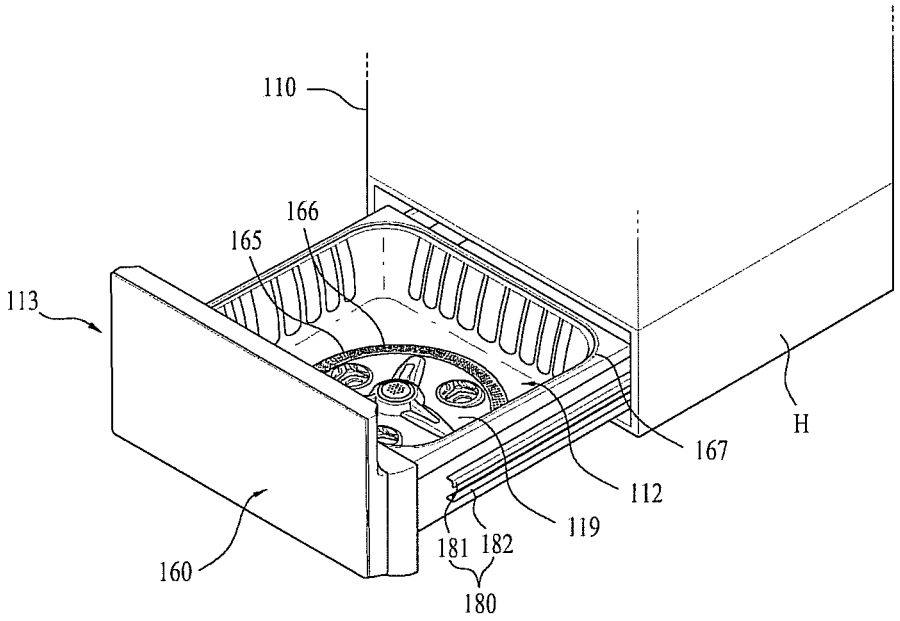
FIG. 8 shows a second treating device in the washing machine of FIG. 7.

FIG. 8 is a perspective view of the second treating device and the second treating device 113 according to one embodiment. As shown, the second treating device is included in a housing (H) for defining an exterior appearance thereof and a drawer 160 that is movable outwards from the housing.

Figure 11:
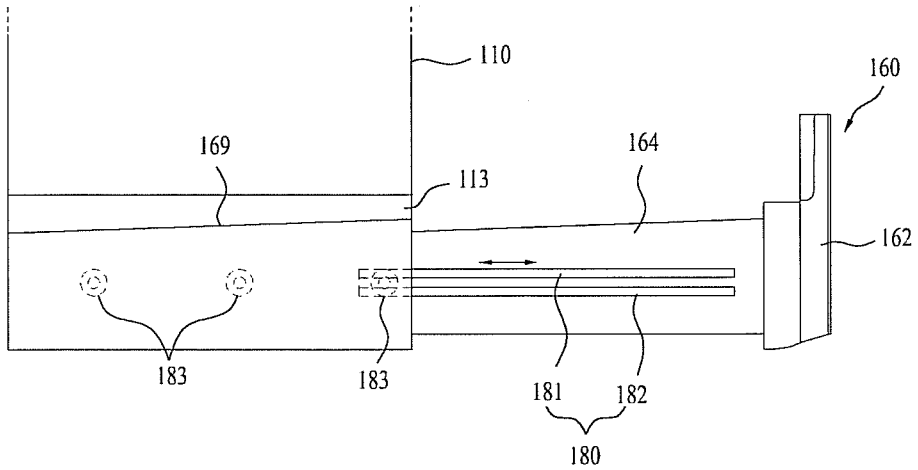
FIG. 11 shows an outward-movement structure of a drawer in a second treating device.

The drawer 160 may include a front surface (162, see FIG. 11) and a body part (164, see FIG. 11). A tub 112 may be provided in the body part 164 and the tub 112 forms a second space in which laundry is held. In other words, the tub 112 for holding wash water and laundry may be provided in the body part 164 and a pulsator 119 for rotating wash water may be installed in the tub 112. The pulsator 119 may be approximately disk-shaped and driving means such as a motor for rotating the wash water may be mounted in a lower portion of the pulsator 119.

Also, a recess part (168, see FIG. 9) recessed a predetermined depth may be formed in a bottom surface of the tub 112 and the recess part 168 may be formed in a ring shape to surround an outer circumferential surface of the pulsator 119. The recess part 168 is recessed a predetermined depth from the bottom surface of the tub 112 and a small amount of wash water remaining in the tub 112 may be collected.

To form the recess part 168, the bottom surface of the tub 112 may be recessed toward the ground. In this instance, the surface where the recess part 168 is formed may be inclined or curved.

Meanwhile, a cover 165 may be provided in the recess part 168 and a drainage hole 166 may be formed in the cover 165.

Accordingly, the wash water held in the tub may flow to the recess part 168 via a plurality of drainage holes 166 and foreign matters contained in the wash water may remain in the cover 165 in this process.

The plurality of the drainage holes 166 may be uniformly distributed in the cover 165. A gasket 167 may be provided in an outer circumferential surface of an upper portion of the tub (112, namely, the second space). The gasket 167 may be installed along the outer circumferential surface of the tub 112, with being projected a predetermined height toward a top of the tub 112.

The gasket 167 may be formed of an elastic material (a material having a restitution force) that is transformed when an external force is applied and restituted when an external force is removed. In other words, the gasket 167 may be formed of rubber that can be transformed easily by a compressive force.

Figure 9:
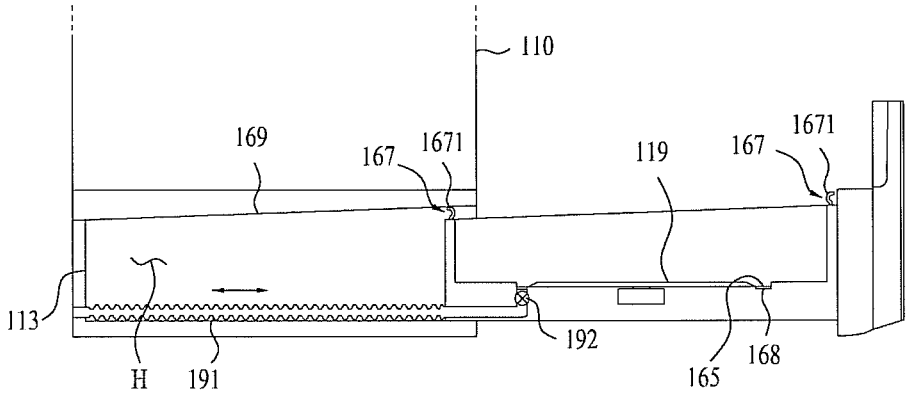
FIG. 9 shows a sectional view of the washing machine in FIG. 7.

Meanwhile, as shown in FIG. 9, a top surface of the tub 112 may be inclined. In this instance, a drawer cover 169 may be provided in the housing (H) of the second treating device 113 to receive the inclined surface of the tub 112.

When the drawer 160 is moved into the housing (H), the tub 112 is closed by the drawer cover 169 airtight and the laundry and the wash water held in the tub may not escape out of the tub 112. Accordingly, it is preferred that the top surface of the tub 112 and the drawer cover 169 have a corresponding slope. Especially, the top surface of the tub 112 may be inclined downwardly toward the direction of the drawer 160 inserted in the housing.

The structure for closing the tub may be realized by an inclined surface provided in a top surface of the body part 164 and a drawer cover 169 provided in the housing (H) of the second treating device 113 to receive the inclined surface of the body part 164, different from the structure mentioned above.

Meanwhile, the cover 165 in which the plurality of the drainage holes 166 are provided may be provided in the recess part 168 and the cover 165 may be spaced apart a predetermined height from a bottom surface of the recess part 168. Accordingly, the wash water drained via the drainage holes 165 may be collected in recess part 168.

Figure 10:
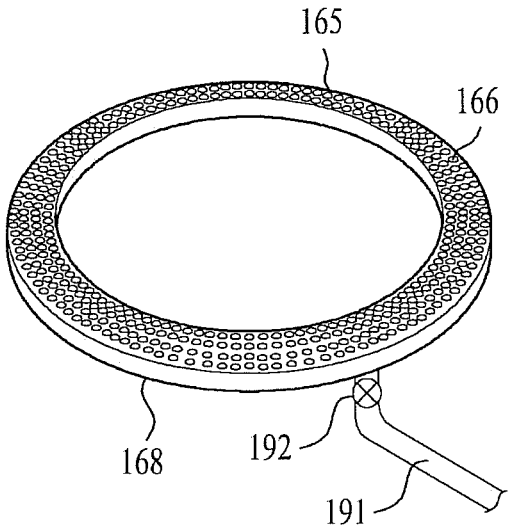
FIG. 10 shows a drainage structure in the washing machine of FIG. 7.

As shown in FIG. 10, the recess part 168 may be connected with a drainage pipe 191 for guiding the wash water outside the second treating device 113. A drainage valve 192 may be installed in the drainage pipe 191 to open and close the drainage pipe. Accordingly, when the drainage valve 192 opens the drainage pipe 191, the wash water collected in the recess part 168 may be exhausted outside the second treating device 113 via the drainage pipe 191. At this time, the drainage pipe 191 may be a bellows pipe of which an outer circumferential surface has a plurality of corrugations.

When the drawer 160 is sliding into the housing (H), the corrugations formed in the drainage pipe are narrowed and the length of the drainage pipe is reduced. However, when the drawer 160 is sliding out of the housing (H), the corrugations formed in the drainage pipe are unfolded and the length of the drainage pipe 191 is increased. Accordingly, the drainage pipe 191 may maintain the connected state to the recessed part 168, regardless of the sliding outwards or inwards with respect to the housing (1-1) of the second treating device 113.

When the drawer 160 is moving into the housing (H), the gasket 167 may contact with the drawer cover 169 and the internal space of the tub 112 may be closed airtight. At this time, the gasket 167 may be pressed toward the drawer 160 by the contact with the drawer cover 169.

The gasket 167 may have a curved part 1671. The curved part 1671 may be the corrugation fondled in the gasket to increase the contact area with the drawer cover 169. Also, when the gasket 167 is compressed by the drawer cover 169, the curved part 1671 may ease the transformation of the gasket. There may be an effect of maintaining the strong contact state between the gasket 167 and the drawer cover 169 when the drawer 160 is moved into the housing (H). Accordingly, the inner space of the tub 112 may be closed airtight by the gasket 167 and the drawer cover 169.

FIG. 11 is a diagram illustrating the sliding structure of the drawer 160. The drawer 160 includes a rail 180 provided in the body part 164 and a roller 183 provided in the housing (H) to guide the movement of the rail 180. The rail 180 may be provided with a first rod 181 provided in the body part 164 and a second rod 182 spaced apart a predetermined distance from the first rod 181.

The first rod 181 and the second rod 182 may be a bar type extended in a longitudinal direction and the rail 180 may be provided in each of facing lateral surfaces of the body part 164.

A plurality of rollers 183 may be provided in the housing (H) and the rollers 183 may be accommodated in the rail 180 to guide the movement of the drawer 160. The plurality of the rollers 183 may be installed in a horizontal direction and they may be rotatable only to reduce the frictional force generated between the first rod 181 and the second rod 182 when the drawer 160 is moving.

The operation of the washing machine 100 mentioned above will be described as follows. First, the drawer 160 is moved outward from the housing (H). At this time, the rollers 183 arranged between the first rod 181 and the second rod 182 are rotated to guide the horizontal movement of the drawer 160. The plurality of the corrugations formed in the drainage pipe 191 may be unfolded and the length of the drainage pipe 191 may be increased.

When the drawer 160 is moving outward from the housing (H), the user loads laundry into the tub 112 and the drawer 160 is moving into the housing (H). In this instance, the rollers 183 arranged between the first rod 181 and the second rod 182 guide the horizontal movement of the drawer and the length of the drainage pipe 191 is getting increased as the plurality of the corrugations formed in the drainage pipe 191 are unfolded.

After that, wash water is supplied to the tub 112. Although the structure of supplying the wash water to the tub 112 is not described specifically, referring to the drawings, a water supply valve and a water supply pipe may be installed in the second treating device 113.

Once the laundry and the wash water are supplied to the tub 112, the pulsator 119 is rotated by the motor to wash the laundry. The pulsator 119 may be rotated in a clockwise direction or counter-clockwise direction or it may be alternatively rotated in a clockwise and counter-clockwise direction. The pulsator 119 may repeatedly perform rotation and stops the rotation (that is, it may be intermittently rotated), to wash the laundry.

Once the washing is complete, the drainage valve 192 is open and the wash water held in the tub is exhausted out of the second treating device 113 via the drainage pipe 191.

In other types of washing machines, wash water might remain in the tub. However, in accordance with one embodiment of the second treating device, the drainage pipe 191 is connected to the recess part 168 positioned lower than the bottom surface of the tub 112 to allow the wash water in the tub to drain away.

Figure 12:
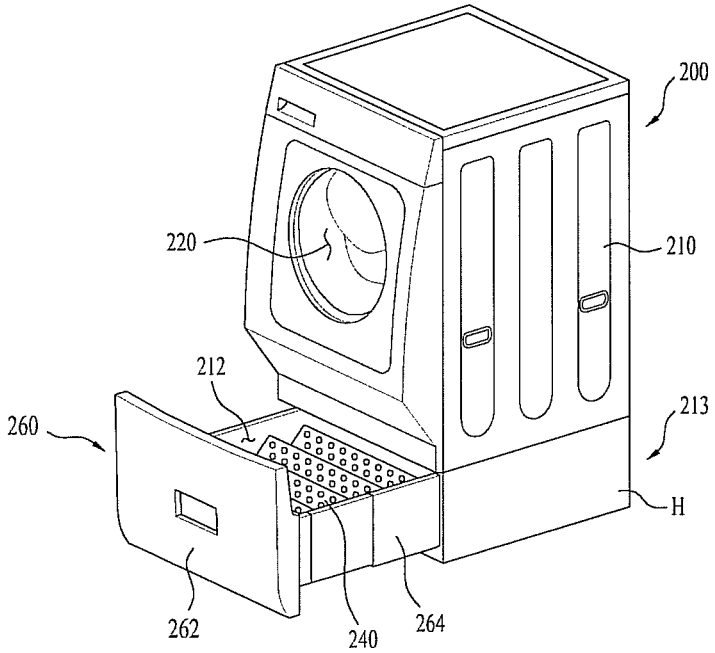
FIG. 12 shows another embodiment of a drying machine.

FIG. 12 shows another embodiment of a drying device 200 provided in the laundry treating apparatus. The drying machine 200 according to this embodiment may also include a first treating device 210 with a first space 220 for treating laundry and a second treating device 213 positioned under the first treating device, with a second space 212 for treating laundry.

The second treating device 213 may include a housing (H) having an open front surface, a drawer 260 movable outwards from the housing, a second space 212 provided in the drawer 260 and a drying rack 240 provided in the second space 212. The housing (H) is box-shaped with an open front. The drawer 260 is movable outward from the housing via the open front of the housing (H) and it is box-shaped with an open top.

The drawer 260 includes a front surface 262 and a body part 264. The second space 212 may be provided in the body part 264. Hot air is supplied to the second space to thy the laundry loaded in the second space. Rather than the hot air, steam and the like may be supplied to the second space 212 to refresh laundry.

The term of 'refresh' is defined as a process of removing of wrinkles or crumples from the laundry by supplying air, hot air, steam, mist or water elements, deodorizing, sanitizing, static electricity preventing or laundry warming. Also, the laundry mentioned in the specification includes not only clothes but also wearable items such as shoes, shocks, gloves and hats.

The drawer 260 may perform the sliding movement and the rail (not shown) may be provided in the body part 264 to ease the sliding movement. Also, a handle (not shown) for moving the drawer inward or outward may be provided in the front surface 262.

In accordance with one embodiment, the drying rack 240 provided in the second space 212 has a foldout structure. In this instance, an end of the drying rack 240 is fixed in the second space 212 and the user may fold or unfold the drying rack 240 if necessary. When the drying rack 240 is unfolded, the second space 212 is divided into an upper space and a lower space. When the drying rack 240 is folded, the second space 212 is a single space.

Figure 13:
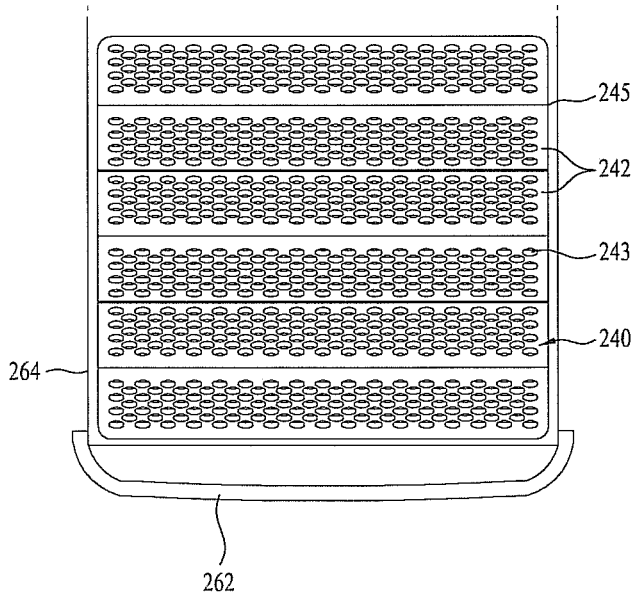
FIG. 13 shows a second treating device in the drying machine of FIG. 12.
Figure 15:
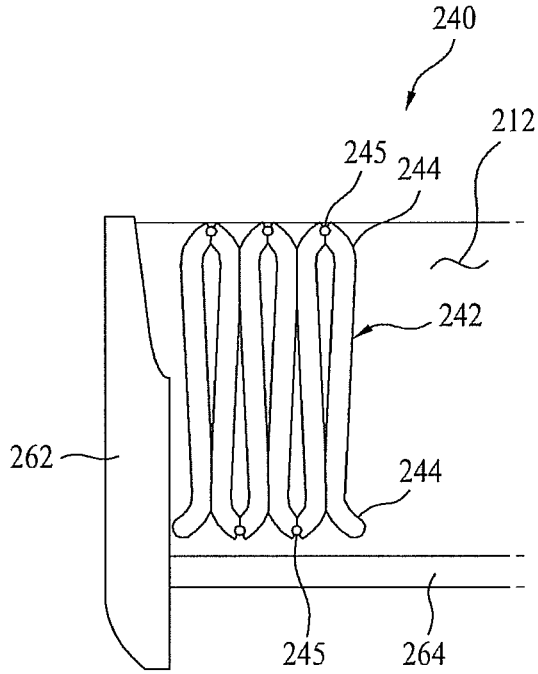
Figure 16:
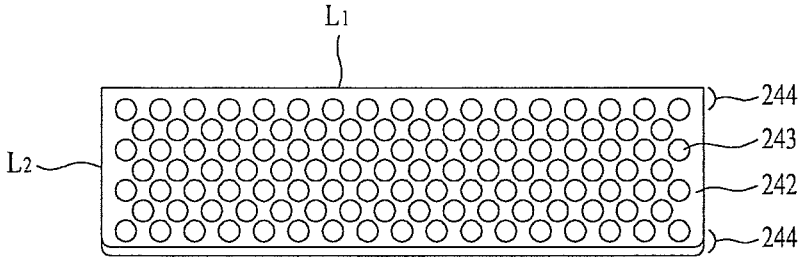

Accordingly, when a large space is necessary for drying laundry such as shoes, the drying rack 240 is folded toward a predetermined side of the second space 212 to secure an internal space as shown in FIG. 15. When it is necessary to maximize the contact area between the laundry such as socks and the hot air, the drying rack 240 is unfolded as shown in FIG. 13 to be used as means for hanging out the laundry.

When the drying rack 240 is unfolded in the second space 212, crests and troughs may be formed in the drying rack 240. That is for the drying rack 240 to provide a wider surface area than a bottom surface of the second space 212.

The drying rack 240 may be detachably provided in the second space 212 and it is preferred that the drying rack 240 is unseparably provided in the second space 212. It might be inconvenient of the user to keep the detachable drying rack 240 in an auxiliary space. However, the drying rack 240 may have an end fixed in the second space to be foldable according to one embodiment.

In addition, only if the drawer is completely moved outward from the housing (H), the detachable drying rack 240 can be installed in the second space 212. However, the drying rack 240 having the end fixed in the second space 212 can be unfolded advantageously, even if the drawer 260 is not completely moved outward from the housing (H).

As shown in FIG. 13, the drying rack 240 is provided with a plurality of plate-shaped members 242. The plate-shaped members 242 are connected with each other by a hinge 245. The plate-shaped members 245 may be connected with each other to form the crests and troughs or to differentiate a rotational direction of one of the plate-shaped members from the others.

Figure 14:
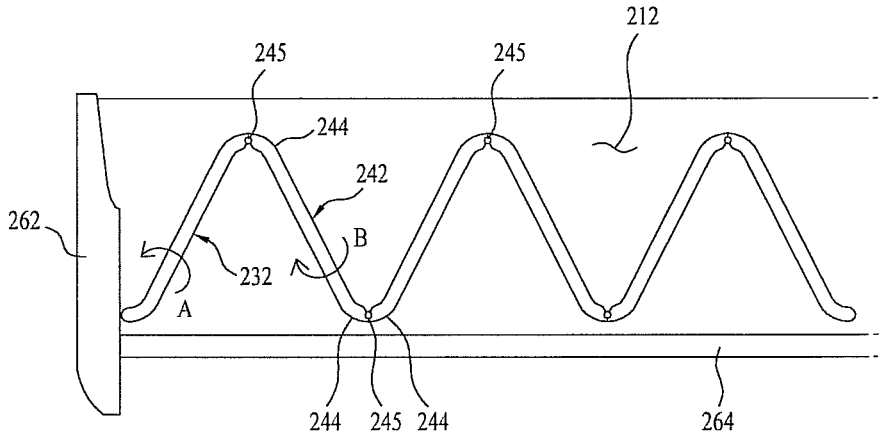
FIGS. 14 to 16 show a drying rack in the drying machine of FIG. 12.

In other words, when a plate-shaped member that is a standard is rotatable in a counter-clockwise direction (A) as shown in FIG. 14, another one connected with the plate-shaped member may be hingedly connected to be rotatable in a clockwise direction (B). The plate-shaped member 242 may include a plurality of through-holes for air flow. The appearance of the through-hole 243 is not limited to a circular shape shown in the drawings.

A side of the plate-shaped member 242 connected to the hinge 245 may be a horizontal side (L1) and a side neighboring the horizontal side (L1) may be a vertical side (L2). In this instance, the length of the horizontal side (L1) possessed by the plate-shaped member 242 may be smaller than the width of the second space, for the second space 212 to accommodate the plate-shaped member 242. The length of the vertical side (L2) possessed by the plate-shaped member may be smaller than the height of the second space 212 for the drawer to be movable into the housing (H) in a state where the drawer is folded.

In addition, the plate-shaped member 242 may have an S-shaped-section as shown in FIG. 14. In other words, both ends 244 of the plate-shaped member 242 may be curved in opposite directions. When the drying rack 240 is unfolded, the connected portion between the plate-shaped members 242 may form a gentle curvature to prevent damage to the laundry that might be generated by the connected portions.

For that, an end 244 of one plate-shaped member 242 and an end 244 of a neighboring plate-shaped member 242 may be curved to form a curved surface having a predetermined curvature when they are connected after the drying rack 240 is unfolded.

FIG. 14 illustrates the drying rack 240 fixed to a front surface of the second space 212 (a rear surface of the front surface 262) and the present invention is not limited to FIG. 14. In other words, the drying rack 240 may be foldable fixed to a rear surface of the second space 212 or to a lateral surface of the second space 212.

As described above, the inner structure of the second space 212 provided in the second treating device 213 of the drying device 200 according to this embodiment may be changed by the drying rack 240. An optimal drying space according to the laundry can be provided and there is an effect of providing a drying device with a high drying efficiency.

In accordance with one embodiment, a laundry treatment apparatus includes a first treatment device to perform a first laundry treating operation, the first device having a first space to receive laundry through a first opening, a second treatment device to perform a second laundry treating operation, the second device having a second space to receive laundry through a second opening, and at least one controller to control the first and second devices to perform the first and second laundry treating operations respectively. The first device is coupled over the second device, and the first and second laundry treating operations are washing operations or the first and second laundry treating operations are drying operations.

The first space may have a volume different from the second space, and in one case the first space may have a volume greater than the second space.

Also, the first opening may be oriented in a first direction and the second opening may be oriented in a second direction different from the first direction. The first and second directions may cross one another.

Also, the first device may include a tub which includes the first space and wherein the tub is oriented in a slanted direction relative to the first opening.

Also, the second device may include a drawer which includes the second space and the drawer may slide in opposite directions to expose and close the second opening. The first laundry treating operation and the second laundry treating operation may be different washing operations, or the first laundry treating operation and the second laundry treating operation may be different drying operations.

Also, the first device may include a rotatable drum that includes the first space, and the second device may include a pulsator to perform the second laundry treating operation. The second device may include a drum that includes the pulsator, and an opening coupled to a drain may be provided to allow water to exit the drum of the second device during or after the second laundry treating operation.

Also included is a drawer that includes the drum containing the pulsator, and a coupling between the opening and the drain may be maintained when the drawer moves between first and second positions to respectively uncover and cover the drum containing the pulsator.

Also, the first device may have a first drum that includes the first space and the second device may have a drawer that includes the second space. The drawer may move between open and closed positions to expose and close the second space respectively, and the first laundry treating operation and the second laundry treating operations may be drying operations.

Also, a drying rack may be included in the drawer of the second device. The drying rack may move between first and second positions in the drawer.

Also, a front surface of the first device may be slanted relative to a front surface of the second device. A supporter may be provided between the first and second devices, where the supporter raises the first device to a predetermined height greater than a height of the second device.

Also, the supporter may have a front surface that is at least partially inclined relative to a front surface of the second device. A height of a front surface of the supporter may be different from a height of a front surface of the second device.

Also, a door of the first device may cover the controller. Or, the controller may be exposed along a surface of one of the first device or the second device or an area between the first and second devices when a door of the first device is closed.

Also, the at least one controller may include a first controller to control the first treatment device to perform the first laundry treatment operation, and a second controller to control the second treatment device to perform the second laundry treatment operation, and the first laundry treatment operation may be performed independently from the second laundry treatment operation.

Terminology used in the present specification selects common expressions well known and used currently, and the terminology may be varied by intensions of those who skilled in the air the present invention pertain to, practices or emergence of new technologies. In a specific case, there may be terminology selected by the applicant of the present specification on his or her own discretion and meaning of corresponding terminology will be described in the detailed description. As a result, the terminologies used in the present specification has to be understood based on substantial meaning possessed thereby and contents of the specification, not based on simple titles of the terminologies.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. The features of one embodiment may be combined with the features of one or more of the other embodiments.

Although embodiments have been described with reference to a number of illustrative embodiments, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

We claim:

1. A laundry treating apparatus, comprising:

a first treating device comprising a cabinet provided with an opening to load and unload laundry therethrough and a first space including a drum positioned in the cabinet to treat the laundry loaded through the opening;

a support that provides a storage space and supports the first treating device, wherein the support is integrally formed with the first treating device;

a second treating device provided underneath the support, wherein the second treating device comprises a second space including a drawer to treat laundry;

first inclined surface inclined in a direction that extends away from a vertically-extending front surface of the support, wherein the opening is provided in the first inclined surface; and a second inclined surface that extends from the first inclined surface, wherein the second inclined surface is inclined toward the vertically-extending front surface of the support, and wherein a connection point, between the first inclined surface and the second inclined surface projects in a direction that extends away from a vertically-extending front surface of the second treating device, wherein the front surface of the support and the front surface of the second treating device are co-planar.

2. The laundry treating, apparatus according to claim 1, further comprising:

a door provided in the first inclined surface to open and close the opening, wherein the door is tilted at a first angle with respect a line that extends perpendicular to the ground.

3. The laundry treating apparatus according to claim 2, further comprising:

at least one detergent introduction portion provided at a lower portion of the opening to supply detergent to the first space.

4. The laundry treating apparatus according to claim 3, wherein the at least one detergent introduction portion has an inclination angle which is larger than the first angle with respect to a line that extends perpendicular to the ground.

5. The laundry treating apparatus according to claim 3, wherein the door opens and closes the opening and the at least one detergent introduction portion.

6. The laundry treating apparatus according to claim 2, further comprising:

a steam generator that supplies steam to the first space; and a water element introduction portion provided at a lower portion of the opening to supply a water element to the steam generator.

7. The laundry treating apparatus according to claim 6, wherein the door opens and closes the opening and. the water element introduction portion.

8. The laundry treating apparatus according to claim 1, wherein the first space comprises:

a tub that holds wash water, in communication with the opening; and the drum rotatably provided in the tub, in communication with the opening, wherein a lowest height of the tub is equal to or greater than a half of a height of the laundry treating apparatus.

9. The laundry treating apparatus according to claim 1, wherein the second treating device comprises:

a housing provided under the support, wherein the housing defines an exterior appearance of the second treating device; and the drawer movable from and into the housing, wherein the second space is formed in the drawer, and wherein a top of the drawer includes an inclined surface inclined downward along a movement direction of the drawer moved into the housing, and wherein the housing further comprises a drawer cover that closes the tub by contacting the inclined surface of the drawer.

10. The laundry treating apparatus according to claim 9, wherein the second space is provided with wash water and a tub that holds laundry, and wherein a gasket is provided at an outer circumferential surface of a top of the tub to contact the drawer cover when the drawer is moved into the housing.

11. The laundry treating, apparatus according to claim 9, further comprising:

a pulsator provided in the tub to form water currents, wherein a recess recessed a predetermined depth is provided in a bottom surface of the tub to collect wash water.

12. The laundry treating apparatus according to claim 11, further comprising:

a drainage pipe in communication with the recess to drain the wash water remaining in the tub outside of the second treating device; and a cover provided in the recess and having a plurality of drainage holes formed therein, wherein the cover is spaced apart a predetermined height from a bottom surface of the recess.

13. The laundry treating apparatus according to claim 1, wherein the second treating device, comprises:

a housing provided under the support, wherein the housing defines an exterior appearance of the second treating device;

the drawer movable from the housing, wherein, the second space is formed in the drawer; and a drying rack fixed to a first surface of the second space to be unfolded to a second surface of the second space or to be folded to the first surface of the second space.

14. The laundry treating apparatus according to claim 13, wherein the drying rack comprises a plurality of plate-shaped members and a hinge that rotatably connects the plate-shaped members with each other, and wherein one of the plate-shaped members is rotated in a direction opposite to a neighboring one.

15. The laundry treating apparatus according to claim 14, wherein the plurality of plate-shaped members is connected with each other by the hinge to form crests and troughs when the drying rack is unfolded in the second space.

16. The laundry treating apparatus according to claim 15, wherein the plurality of plate-shaped members is formed in a shape for the crests and troughs to form a curved surface with a predetermined curvature when the drying rack is unfolded in the second space.

17. The laundry treating apparatus according to claim 15, wherein a length of a horizontal side of each plate-shaped member that is defined as a side in parallel to the hinge is smaller than a width of the second space, and a length of a vertical side of each plate-shaped member that is defined as a side perpendicular to the hinge is smaller than a depth of the second space.

18. A laundry treating apparatus, comprising:

a first treating device comprising a cabinet provided with an opening to load and unload laundry therethrough and a first space including a drum positioned in the cabinet to treat the laundry loaded through the opening;

a support that provides a storage space and supports the first treating device;

a second treating device provided underneath the support, wherein the second treating device comprises a second space including a drawer to treat laundry;

at least one detergent introduction portion provided in the cabinet and located at a lower portion of the opening to supply detergent to the first space; and a door provided in the cabinet to open and close the opening, wherein the door is configured to open and close the at least one detergent introduction portion when the door opens and closes the opening, wherein the front surface of the support and the front surface of the second treating device are co-planar.

* * * * *